US005747954A

United States Patent [19]

Jones et al.

[11] Patent Number: 5,747,954

[45] Date of Patent: May 5, 1998

[54] HIGHWAY CROSSING GUARD MECHANISM CONTROLLER

[75] Inventors: Richard S. Jones, West Columbia; N. Rodgers Williamson, Jr., Leesville, both of S.C.

[73] Assignee: Union Switch & Signal Inc., Pittsburgh, Pa.

[21] Appl. No.: 790,777

[22] Filed: Jan. 30, 1997

[51] Int. Cl.[6] ..... B61L 29/08

[52] U.S. Cl. ..... 318/266; 318/286; 318/380; 318/468; 246/125

[58] Field of Search ..... 318/264, 265, 318/266, 267, 286, 369, 370, 371, 373, 430, 431, 434, 466, 467, 468, 375, 379, 380; 246/125–129

[56] References Cited

U.S. PATENT DOCUMENTS

| | | | |
|---|---|---|---|
| 3,601,603 | 8/1971 | Hughson . | |
| 3,877,174 | 4/1975 | McDonald . | |
| 3,964,704 | 6/1976 | Karr . | |
| 4,369,943 | 1/1983 | Hussein . | |
| 4,855,653 | 8/1989 | Lemirande . | |
| 5,092,544 | 3/1992 | Petit et al. | 246/126 |
| 5,098,044 | 3/1992 | Petit et al. | 246/187 |
| 5,502,367 | 3/1996 | Jones | 318/281 |
| 5,543,596 | 8/1996 | Jones et al. | 200/573 |

OTHER PUBLICATIONS

Data sheet from Microsemi Corp., Scottsdale, AZ, for transient absorption zener device, series 1N6267 thru 1N6303A and 1.5KE6.8 thru 1.5KE400A, pp. 4–15 and 4–16.

*Primary Examiner*—Bentsu Ro
*Attorney, Agent, or Firm*—Kevin A. Sembrat

[57] ABSTRACT

A highway crossing gate control circuit is provided which minimizes the "pumping" oscillation of a highway crossing gate arm which is driven up by a permanent magnet motor. A preferred embodiment of the control circuit utilizes a p-channel MOSFET in a power down module of the control circuit to restrict power from being applied to the motor when the gate arm is in an up position and is intended to be held in the up position by a hold clear device which acts as a mechanical break. Provision is included for dynamic braking on the gate arm moving downward after an initial drive down mode.

9 Claims, 2 Drawing Sheets

HIGHWAY CROSSING GUARD MECHANISM CONTROLLER

BACKGROUND OF THE INVENTION

The present invention relates generally to an electrical circuit for controlling the drive mechanism of a highway crossing gate, and more particularly, to an electrical circuit for controlling the drive mechanism of that crossing gate during a power down function. Such gate mechanisms may also be used at other crossings or areas where it is desired to alert traffic on one right-of-way to the approach of traffic or vehicles on the crossing right-of-way.

Generally, these mechanisms use a crossing arm which is counterweighted to a generally horizontal position and which is selectively raised through the use of a drive motor. Such mechanisms can be characterized as those using a two-wire system and those using a three-wire system. In a two-wire system, the two wires refer to a control signal which indicates the arm should be in a raised or up position. The second wire in a two-wire system refers to a power wire. In a so-called three-wire system, the first control signal indicates a desired arm-up position, a second control signal indicates a desired arm-down position, and a power wire constitute the three wires. In both the two-wire and three-wire systems, the nomenclature omits the fact that a common wire is also used.

This invention relates to the type of crossing control known as a two-wire system (actually having at least three wires including a common wire) which gets an input signal indicating the desirability to have an arm-up position and a power source. In addition, the highway crossing mechanisms generally use DC drive motors, often through internal gearing, to raise and lower the gate arm. Highway crossing mechanisms can also be characterized by the type of motor used to control both the up and downward movement of the crossing arm, namely permanent magnet motor or field coil motors. This invention relates to a permanent magnet motor type crossing gate control circuit of the two-wire type.

It is the desire in highway crossing gates to maintain a high level of vitality. Vital crossing design is such that component failures are minimized and when such failures do occur, the overall device tends to fail in a default mode. This can be seen in that the highway crossing design generally uses a gravity force to lower the crossing arm. As such, should an input signal fail, the unit can be lowered through the force of gravity to a horizontal or blocking position. To maintain the vital concept throughout the equipment includes the desire to minimize electrical components in the circuit.

Control of the motor in the highway crossing mechanism requires a bidirectional motor operation. Specific prior art circuits are shown in U.S. Pat. No. 5,502,367, issued Mar. 26, 1996 in the name of Jones, entitled "Highway Crossing Control", which is incorporated herein by reference. Further, U.S. Pat. No. 5,543,596, issued Aug. 6, 1996 in the name of Jones et al., entitled "Highway Crossing Gate Mechanism Circuit Contact", is incorporated herein by reference. However, the prior art does not address the problem known in the art as "pumping", wherein the gate arm oscillates between an up position and a partially up position. Specifically, highway crossing guard mechanisms currently in use at highway crossings are generally composed of a motor, gears, a "hold-clear" device, and a circuit controller housed in a protective box. The circuit controller switches the motor and hold-clear device, as well as provides information to various external functions within the highway crossing system. The controls are chiefly dependent on the position of the gate arm, wherein the arm may be down across the highway (horizontal), up (vertical or "clear"), or somewhere in between these two positions. As is known in the art, the circuit controller has electrical contacts with positions which are controlled by a series of cams which are mounted directly to the main output shaft of the guard mechanism.

After a train clears the highway crossing, and as the gate arm is lifted and arrives at the vertical (clear) position, the power-up control contacts open, thus shutting off power to the motor and switching power to the hold-clear device. The hold-clear device consists of an electromechanical brake which, when energized, holds the arm in the vertical position. Without the hold-clear device, the gate arm is balanced in such a way that it would, by means of gravity force, fall to the horizontal position.

"Pumping" is a condition which may occur if the "up signal" coming to the guard mechanism is lost for just the right duration of time and then reappears. In essence, the "up signal" is allowed to "bobble" for a short duration. When the "up signal" is lost momentarily, the brake contact releases, but the motor up contact is not fully made. It is possible for the arm to drop back down just enough to re-energize the motor. The motor then drives the gate arm back up. At this point, however, it is possible that the hold-clear contacts will not reconnect, thus the gate arm is allowed to fall back to the position where the power up contacts reconnect. The gate arm is again driven upward. The condition which now exists is one in which the gate arm is oscillating, or what is known in the railroad industry, as "pumping". The "pumping" condition can cause undue stress and damage to the guard mechanism.

SUMMARY OF THE INVENTION

It is therefore an object of the present invention to provide an electronic controller for the power down function of a highway crossing guard mechanism that eliminates the "pumping" condition that can cause undue stress and damage to the guard mechanism.

It is a feature of the present invention to provide an electronic power down module, preferably utilizing a MOSFET (Metal Oxide Semiconductor Field Effect Transistor) switch, with relay switches to control a permanent magnet motor.

In accordance with a preferred embodiment of the present invention, an electronic power down module and a single motor-controlled relay having controller contacts control a permanent magnet motor according to a power signal and up signal received at the highway crossing relay. The permanent magnet motor is controlled to provide a drive-up mode which raises the gate crossing arm, and the drive-down mode in which the arm is driven down by the permanent magnet motor. During the movement downward of the gate arm, the circuit changes from a motor-driven downward mode to a dynamic breaking mode. The single motor control relay has at least three single-pole double-throw contact sets. The circuit utilizes two controller contacts. One controller contact senses the gate arm between an intermediate position and the up position. Another controller contact senses the gate arm in the up position and is a single-pole-double-throw contact. The circuit also utilizes a power down module having a p-channel MOSFET to open and close the power down portion of the circuit in response to the up and power signals.

Briefly described according to another embodiment of the present invention, a highway crossing gate control is provided for eliminating pumping when driving a gate arm between an up position and a down position in response to an up signal, comprising: a permanent magnetic DC motor mechanically connected to drive such gate arm up when rotated in a direction and to drive such gate arm down when rotated in a direction opposite to the direction; a motor control relay connected to the up signal to be energized in response to such up signal; the motor control relay having a first contact set having a connection between a side of the armature of the motor and a first contact upon energization of the motor control relay, and having a connection between the armature and a second contact only when the motor control relay is de-energized; the motor control relay having a second contact set having an open state between a power supply and a first contact upon energization of the motor control relay, and having a connection between the power supply and a second contact when the motor control relay is de-energized; the motor control relay having a third contact set having a connection between the opposite side of the armature and a first contact when the motor control relay is energized and having a connection between the opposite side of the armature and a second contact when the motor control relay is de-energized; a first controller switch having an open state for when such gate arm is in such up position, and a closed state for when such arm is in a position other than such up position; the first controller switch connected between the motor control relay and the power supply; the second contact of the second contact set operably connected to a hold clear device for maintaining such gate arm in the up position; and a switching circuit connected between the power supply and the second contact of the third contact set, such that the switching circuit has an open state when the hold clear device is energized, and a closed state when the hold clear device is deenergized.

An advantage of the present invention is that the potential for "pumping" is minimized.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
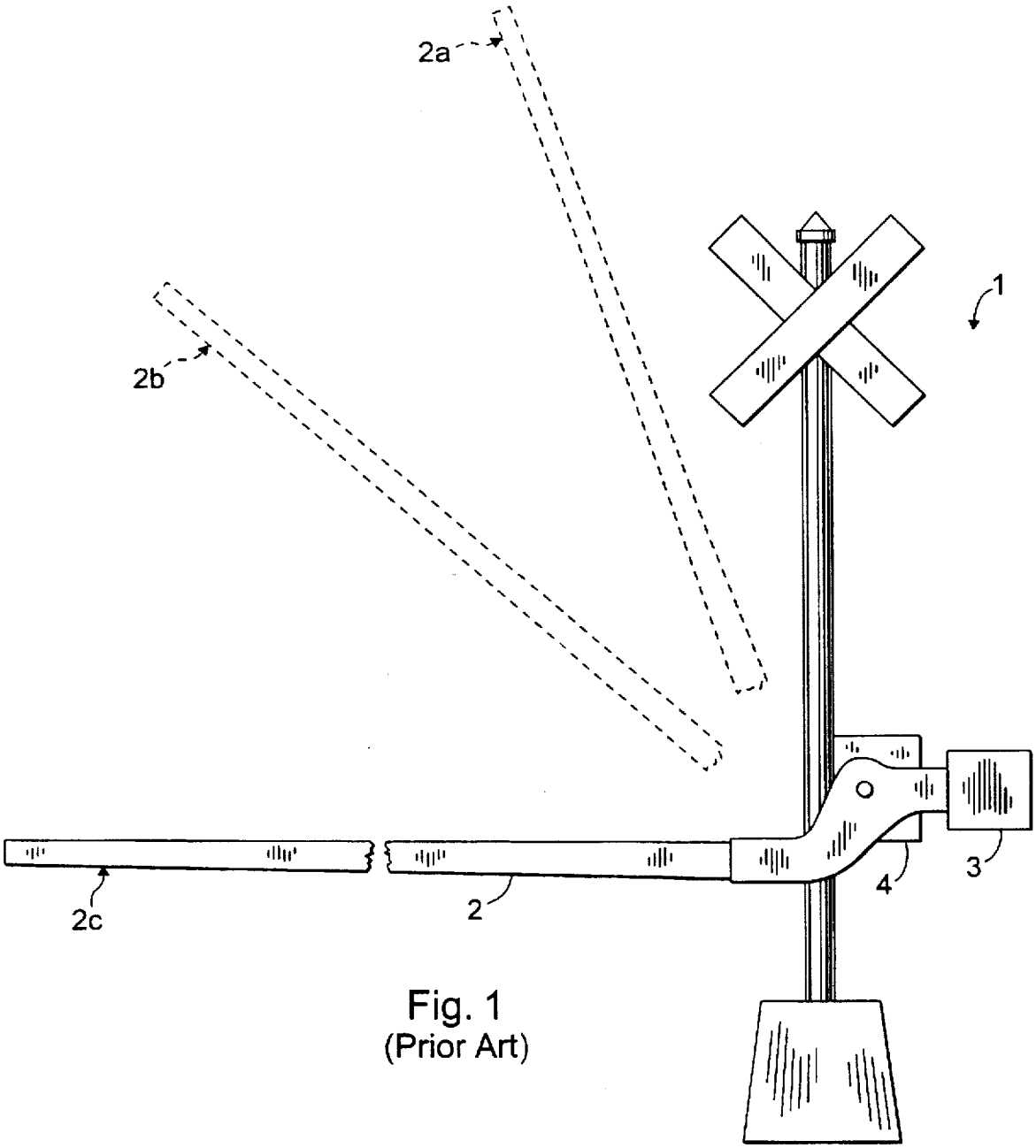
Fig. 1 (Prior Art)
FIG. 1 is an elevational view of a highway crossing mechanism showing three positions of the crossing arm.

FIG. 1 shows a highway crossing gate 1 that is known in the art as having a gate arm 2 that is attached to a mechanism that has a counter weight 3. The mechanism is driven and controlled by equipment contained in a control housing 4. The control housing 4 contains electrical circuit controls, gearing, a controller portion having cam switches and an output shaft which drives the arm pivotally between positions 2*a*, 2*b*, 2*c*. As shown, position 2*c* has the crossing arm in the down or horizontal position. This position is generally used to alert motorists or pedestrians of the presence of a rail vehicle. Counterweights 3 are chosen to offset some of the cantilevered load resulting from arm 2, and thereby to permit the force of gravity to hold arm 2 in a horizontal position absent any external forces generated on the arm by the gate mechanism. When the system does not detect the presence of a rail vehicle or when the up control signal is supplied to the two-wire circuit in housing 4, the arm 2 is raised from position 2*c* to a generally vertical or up position to position 2*a*. For nomenclature purposes, the rotation of the gate arm can generally be thought to be approximately 90°, where the vertical or "up" position 2*a* generally corresponds to 90° and the horizontal or "down" position 2*c*, corresponds to 0°. It is to be understood, however, that these are merely approximations and, in fact, in specific applications the degrees of rotation may vary greater or lesser than that shown in FIG. 1. When the highway crossing gate is in the up position 2*a* and is receiving an electrical signal corresponding to a desired up position, the crossing arm 2 will be held in the position 2*a* by mechanical means such as a shaft brake on the motor. However, when the up signal is not supplied or removed, it is then desired that the crossing arm 2 be power driven downward to position 2*c*. During the first part of the downward cycle, the motor supplies torque to move the arm downward and is assisted by gravity force. However, as the crossing arm moves downward, it accelerates and picks up speed to a point where it is no longer desirable to use the motor drive to push the arm down. In many applications, it is desirable at the position 2*b* to change from a motor-powered down mode to an electrical braking mode using the motor as a generator and dynamic braking the crossing arm 2 as it travels downward from the position 2*b* to the position 2*c*. Using dynamic braking provides a measure of downward speed retardation to the arm, in order to avoid the arm crashing to the horizontal position 2*c*.

Figure 2:
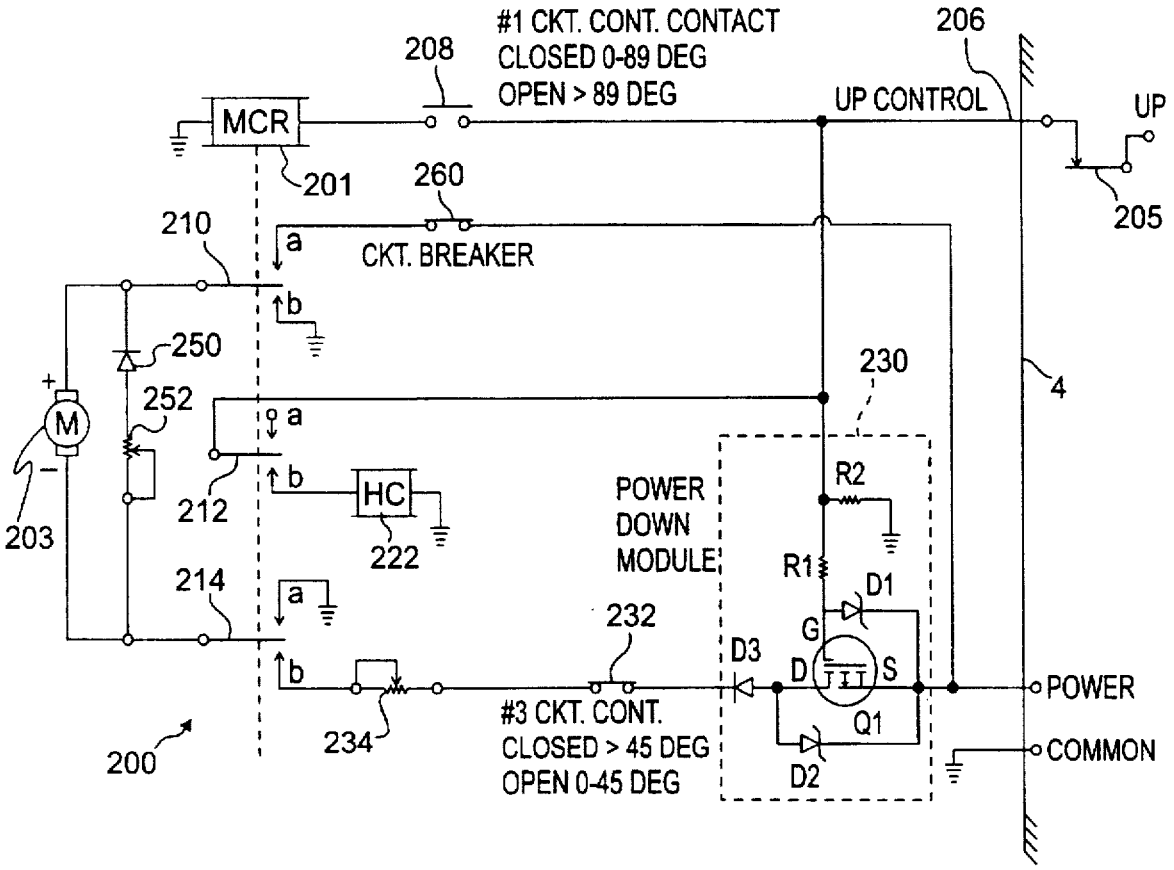
FIG. 2 is a circuit diagram showing an embodiment of the invention using a single motor control relay and a power down module having a p-channel MOSFET to control a permanent magnet motor and to minimize a "pumping" condition.

In FIG. 2, a circuit 200 of a preferred embodiment of the present invention utilizes a single motor control relay 201 to control a permanent magnet motor 203. The control housing 4 contains the circuitry which operates from two external electrical inputs. A highway crossing relay contact 205 provides an up control signal 206, typically a 12-volt signal, signifying that it is desired that the highway crossing arm be in its up position. In addition, a "power source", which may be supplied by a battery (not shown) or other power source, is also supplied to the controller housing 4. Also supplied is a common, and this may be one or more wires which provide for the up and power signal returns. The housing 4 also contains a controller device such as a series of cam-mounted limit switches or other sensors which provide switch closures for specific positions of the gate arm. The controller contacts may be cam-operated limit switches on a main shaft which is driven through gearing by the motor 203. The previously cited U.S. Pat. No. 5,543,596 shows a mechanical arrangement of the contacts and controller mechanisms which are presently preferred.

In operation, the circuit 200 controls the gate arm 2 by reversing the armature voltage supply in response to the desired position for the gate arm 2. A controller contact 208, which is electrically coupled between the motor control relay 201 and the up control signal 206, is positioned in a closed position when the gate arm 2 is sensed to be positioned between 0° and 89° and is positioned in an open position when the gate arm 2 is sensed to be positioned at greater than 89°. It is understood that the positioning of the gate arm 2 at greater than 89° represents an up position, although other angular positions could also be used for up positions in specific applications of this invention.

When the gate arm 2 is in the up position 2*a*, the controller contact 208 is in the open position. Even if the up control signal 206 is present, the motor control relay 201 is de-energized and its contacts fall to their fail-safe "b" positions due to the force of gravity. A first contact 210 would be in its fail-safe de-energized "b" position. Similarly, a second contact 212 would be in its failsafe de-energized "b" position and a third contact 214 would be in its fail-safe deenergized "b" position.

In a preferred embodiment, a hold clear solenoid coil 222 is a shaft-mounted brake (not shown) on the motor 203. As long as power is supplied to the circuit and the up control signal 206 is maintained at the highway crossing relay contact 205, and the controller contact 208 remains open when the gate arm 2 is positioned at greater than 89°, the gate arm 2 will be held in the up position by action of the mechanical brake, which is activated by the hold clear solenoid coil 222 supplied with the up control signal 206 along a path through the second contact 212 in its fail-safe de-energized "b" position.

The gate arm 2 will remain in the up position until a vehicle is sensed, typically when the vehicle shunts the gate crossing approach, thereby causing the highway crossing relay to de-energize, opening the relay contact 205 which causes the 12 volt up control signal 206 to go to 0 volts. Under this condition, it is desirable to drive the arm downward from its uppermost position 2*a*. When the up signal at the highway crossing relay contact 205 is removed, such as would occur when the vehicle is sensed on the rail in close proximity to the crossing, the up control signal 206 is removed from the hold clear solenoid coil 222. As a result, the hold clear solenoid coil 222 de-energizes, thereby releasing the mechanical brake that holds the gate arm 2 in the position 2*a*.

At the same time that the up control signal is removed, thereby deenergizing the hold clear solenoid coil device 222, a power down module 230 operates to close the power down circuit, thereby driving the motor down. Power is fed through the power down module 230, a controller contact 232, current limiting resistor 234, and third contact 214*b* to the motor 203 and then returns via first contact 210*b*. During this period, the motor drives the arm from a position 2*a*to an intermediate position such as, for example, 45° at position 2*b*. When the gate arm 2 is sensed to be positioned between 0° and 89°, for example, the controller contact 208 is closed, but the motor control relay 201 is not energized while the highway crossing relay contact 205 is not closed, and the contacts 210, 212, and 214 are in their fail-safe "b" positions due to the force of gravity. It is understood that the intermediate position where the control will change from a drive-down mode to a dynamic braking or coasting mode can vary, depending on the specific application. The example here is that the circuit will change from a drive-down mode at a point approximately 45°, such as at position 2*b*.

When the gate arm reaches position 2*b*, the controller contact 232 is opened by sensing the position of the arm or main shaft, such as through the action of a cam-operated limit switch. The opening of the contact 232 in the power down module 230 interrupts the motor current, and the motor 203 continues to turn through the inertia and the force of gravity on the gate arm 2 and through the mechanism gearing. The gate arm 2 will continue down due to the weight of the arm until a mechanical buffer spring (not shown) causes the gate arm 2 to stop at the horizontal (0°) position 2*c*. During that time, from position 2*b* to position 2*c*, it will usually be desired to exercise some control over the speed of the descending gate arm 2. Provision is made in a preferred embodiment through the utilization of a snub diode 250 and a snubbing or dynamic braking resistor 252. The snubbing resistor 252 can be chosen to be quite low, such as one ohm, for example, or other value which provides a gradual descent of the gate arm 2 to its horizontal or down position 2*c*.

At a horizontal or down position, the gate arm 2 is in position 2*c* and power is not being supplied to the permanent magnet motor 203. When a vehicle clears the highway crossing and the gate arm 2 should be raised, the highway crossing relay contact 205 closes, thereby applying 12 volts DC to the up control signal 206. While the gate arm 2 is in position 2*c*, the controller contact 208, which is in its closed position when the gate arm 2 is sensed to be positioned in a not up position such as 0° and 89°, causes the motor control relay 201 to energize, and the contacts 210, 212, 214 are moved to their respective "a" positions. Power is now supplied through the first contact 210*a* to the motor 203 and then returned via the third contact 214*a*, thereby driving the motor 203 in the up direction. Should an overload be experienced on the power circuit during the drive-up mode, the embodiment has an overload circuit breaker 260, which would be opened. If the overload is cleared, the overload circuit breaker 260 will reset and maintain its contact. A preferred embodiment of the circuit breaker 260 will trip at 20 amps, for instance, and typically within about three minutes of the gate arm 2 becoming stalled, for instance.

As the arm continues up and reaches approximately 90°, the controller contact 208 moves from its closed position to its open position, thereby deenergizing the motor control relay 201. As a result, the contacts 210, 212, and 214 drop by gravity force to their "b" positions, thereby feeding power to the hold clear solenoid coil 222 that sets the brake to hold the gate arm 2 in the uppermost position 2*a* past approximately 89°. At the same time, a gate G of the p-channel MOSFET Q1 in the power down module 230 will open the power down portion of the circuit.

As shown in FIG. 2, the power down portion comprises a controller contact 232, a current-limiting resistor 234, and the power down module 230, which comprises a zener diode D1, a transient absorption zener device D2, a diode D3, and resistors R1 and R2. As is known in the art, the p-channel MOSFET Q1 has a drain D and source S junction that is open with a voltage applied to the gate G. In a preferred embodiment, the resistor R1 is connected between the motor control relay contact 205 and the gate G. The resistor R1 provides a voltage drop for the zener diode D1. Additionally, the resistor R1 limits current flow if the gate G to source S junction becomes shorted, thereby preventing the energization of the motor control relay 201 should the gate arm 2 be positioned in a down position, which would otherwise be an unsafe failure condition. In a preferred embodiment, the zener diode D1 is connected to the gate G to source S junction to protect against spikes and over voltages as known in the art. The resistor R2 assures that the gate G does not float to an improper state. The transient absorption zener device D2, commonly referred to as a "transorb", operates as is known in the art to provide snubbing, for the drain D to source S junction, against inductive kickback from the motor 203. A preferred embodiment of the present invention may utilize a 1.5KE Series transient absorption zener device having a peak pulse power rating of 1500 watts for one millisecond, as manufactured by Microsemi Corp. of Scottsdale, Ariz., U.S.A. In a preferred embodiment, the zener diode D1 may also be a transient absorption zener device similar to D2. The diode D3 assures that, when the motor 203 is operating as a generator, current from the motor 203 does not flow through the power down module 230 to the power source or to the hold clear solenoid coil 222 along the connection for the up control signal 206. The resistor R1 typically has a smaller resistance value than R2, and the resistor R2 can normally be on an order of magnitude of 5K ohms. The current-limiting resistor 234 can normally be on an order of magnitude of 2.5 ohms. Depending on the specific motor characteristics, other values may be chosen.

As shown in FIG. 2, the circuit 200 embodying the present invention uses the motor control relay 201 which moves contacts 210, 212, 214 thereby to activate the hold clear solenoid coil 222 when the gate arm 2 is in an up position, and to activate the power down module 230 thereby to eliminate the pumping condition when the gate arm 2 is being positioned in the down position. While this embodiment has been shown which includes the necessary functions for highway gate control, it is understood that other functions can be added to the embodiment shown in FIG. 2 in the practice of the invention. Multiple stages of dynamic braking, portions of gate arm travel in which the mechanism coasts and other functions provided in conjunction with the control circuit can be utilized. Other controller contacts can be used for various functions, including lights and audible alarms. The embodiment shown can be combined with other functions to provide more complex gate control patterns; however, it may generally be preferred to keep the circuitry as simple as possible to increase reliability and vitality.

The circuit shown uses a single motor control relay. To maintain the high degree of vitality, it is desirable that the relay be what it recognized in the railway signal industry as a vital relay. Preferred embodiments include the utilization of the PN150 Plug-in Relay as sold by Union Switch & Signal Inc., Pittsburgh, Pa. Other vital relays and indeed other relays may be used as the motor control relay in the practice of this invention. While the motor control relay shown has three sets of contacts, it is to be understood that such relay may have other contacts which can be used for additional functions, some specific applications.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A highway crossing gate control for driving a gate arm between an up position and a down position in response to an up signal and a power supply comprising:

a permanent magnetic DC motor mechanically connected to drive such gate arm up when rotated in a direction and to drive such gate arm down when rotated in a direction opposite to said direction;

a first controller switch connected to receive the up signal, having an open state only when the gate arm is in the up position and a closed state only when the gate arm is in a position other than the up position;

a motor control relay connected to said first controller switch, to be energized in response to the up signal when said first controller switch is in said closed state;

a hold clear device for maintaining the gate arm in the up position, said hold clear device to be energized in response to the up signal only when said motor control relay is de-energized;

said motor control relay having a first contact set having a first contact connected to a side of the armature of said motor upon energization of said motor control relay, and having a second contact connected to said side of the armature only when said motor control relay is de-energized;

said motor control relay having a second contact set having a first contact connected to receive the up signal upon energization of said motor control relay, and having a second contact connected to receive the up signal when said motor control relay is de-energized;

said motor control relay having a third contact set having a first contact connected to the opposite side of said armature when said motor control relay is energized and having a second contact connected to said opposite side of said armature when said motor control relay is de-energized;

a switching circuit connected between a power supply and said second contact of said third contact set, such that said switching circuit has an open state in response to the up signal, and otherwise, a closed state, thereby to provide an electrical circuit path between said second contact of said third contact set and said second contact of said first contact set when said switching circuit is in said closed state.

2. The highway crossing gate control of claim 1, further comprising:

a second controller switch in an electrical circuit path between said second contact of said first contact set and said switching circuit; and said second controller switch having a closed state for the gate arm between the up position and an intermediate position, and an open state for the arm between said intermediate position and the down position.

3. The highway crossing gate control of claim 2, further comprising a current limiting resistor in an electrical circuit path between said second contact of said first contact set and said switching circuit.

4. The highway crossing gate control of claim 3, further comprising a shunt path across said armature of said motor; and said shunt path including a dynamic braking resistor and a diode biased to provide dynamic braking when said motor turns in a downward direction.

5. The highway crossing gate control of claim 4 further comprising:

an overload circuit breaker in an electrical circuit path between said first contact of said first contact set and said power supply.

6. The highway crossing gate control of claim 5, wherein said motor control relay is a vital relay.

7. The highway crossing gate control of claim 6, wherein said first controller switch is a single pole double throw cam-operated switch and said up position and said down position use the front and back contacts of said cam-operated switch.

8. The highway crossing gate control of claim 1, wherein said motor control relay is a vital relay.

9. The highway crossing gate control of claim 1, wherein said first controller switch is a single pole double throw cam-operated switch and said up position and said down position use the front and back contacts of said cam-operated switch.

* * * * *